United States Patent [19]

Brangenberg

[11] 3,933,365

[45] Jan. 20, 1976

[54] DEVICE FOR HOLDING TOGETHER A PAIR OF SKIS

[76] Inventor: Ralf Brangenberg, Riffelstrasse 46, 81 Garmisch-Parten Kirchen, Germany

[22] Filed: Nov. 7, 1974

[21] Appl. No.: 521,756

[30] Foreign Application Priority Data

Nov. 10, 1973 Germany ..... 2356312

[52] U.S. Cl... 280/11.37 A; 24/73 SG; 280/11.13 T

[51] Int. Cl.[2] ..... A63C 11/02

[58] Field of Search ..... 24/16 R, 16 PB, 73 SG, 24/81 SK; 105/474; 211/60 SK; 224/5 Z, 45 S; 248/499, 510; D34/14 D, 40; 280/11.13 T, 11.37 A, 11.37 K, 11.37 T

[56] References Cited

UNITED STATES PATENTS

| | | | |
|---|---|---|---|
| 2,267,653 | 12/1941 | Hawkins | 248/124 |
| 2,355,705 | 8/1944 | Cohn | 24/16 R X |
| 3,284,091 | 11/1966 | Spier | 280/11.13 T |
| 3,768,711 | 10/1973 | Wilkinson | 224/45 S |
| 3,826,518 | 7/1974 | Hennig | 280/11.13 T |

FOREIGN PATENTS OR APPLICATIONS

| | | | |
|---|---|---|---|
| 329,763 | 6/1958 | Switzerland | 24/73 SG |
| 225,050 | 8/1910 | Germany | 280/11.13 T |
| 151,062 | 5/1937 | Austria | 280/11.37 A |
| 189,977 | 5/1975 | Austria | 280/11.37 A |

*Primary Examiner*—Roy D. Frazier
*Assistant Examiner*—Lawrence J. Staab

[57] ABSTRACT

A ski holder including a single connecting plate, holding pins and an elastic tensioning element with openings for engaging the holding pins.

2 Claims, 6 Drawing Figures

DEVICE FOR HOLDING TOGETHER A PAIR OF SKIS

The present invention relates to a device for clamping a pair of skis.

A holder for a pair of skis is shown in German publication specification OS 1,578,789 and comprises two connecting plates, on which, in each case, a rubber ring is unreleasably held in an eye. Each connecting plate is here to be fastened by means of two screws located at the same height on each ski.

When not in use, each rubber ring is laid about a raised flap on the end of the connecting plate lying opposite the eye, while for joining of the two skis the ring must be laid about the flap of the connecting plate on the other ski. Aside from the point that there are needed two connecting plates with a rubber ring each, care must be taken that they lie at the same height, i.e., at the same distance from the end of the ski during fastening.

The purpose of the present invention is to achieve the same effect with considerably less expenditure and to provide a practical holder for a pair of skis.

According to the invention this is achieved by a holder which consists of a single connecting plate, to be mounted at will on one of the skis and of a single elastic and flexible tensioning element, which has at each end at least one opening, for which there are provided holding pins spaced from one another on the connecting plate. Thereby the use of material is in practice only half as great as in the known holder. Furthermore, the assembling can be simplified and the assembling time reduced by more than half, since the adjusting and mounting of the second connecting plate becomes unnecessary. The tensioning element can then be detachably connected at one end of the connecting plate and can have at the other end a handle for the drawing around about the two skis and hooking-in of the other opening or eye.

It has proved especially advantageous for the connecting plate to carry in a manner known per se an adhesive coating covered on the ski supporting surface by a removable protective sheet. Hereby the assembling of the holder is possibly still more rapid and simple.

Expediently the connecting plate is of approximately triangular form and carries a holding pin for the tensioning element at the end of the base, in each instance, the triangle apex being, in a manner known per se, at an angle to a hook.

In an embodiment of the invention, the connecting plate can be made rhomboidal in form and having an upward extending rib over the long diagonal, with the holding pins for the tensioning element lying in obtuse angles to the plate. The rib then forms a scratching strip for cleaning the soles of the ski boots of snow or ice before stepping into the ski binding.

The tensioning element can consist of two layers which are clamped together to form hook-in places or eyes for example.

Three examples of embodiments of the subject of this invention are described in detail in the following with the aid of the appended drawings.

Figure 5:
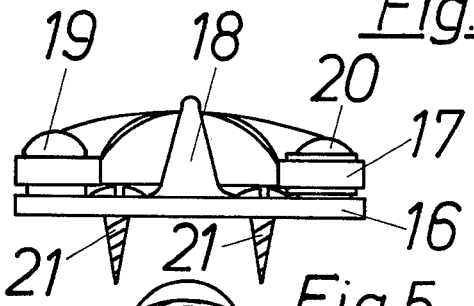
Figure 3:
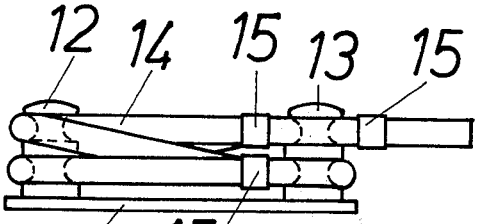
Figure 6:
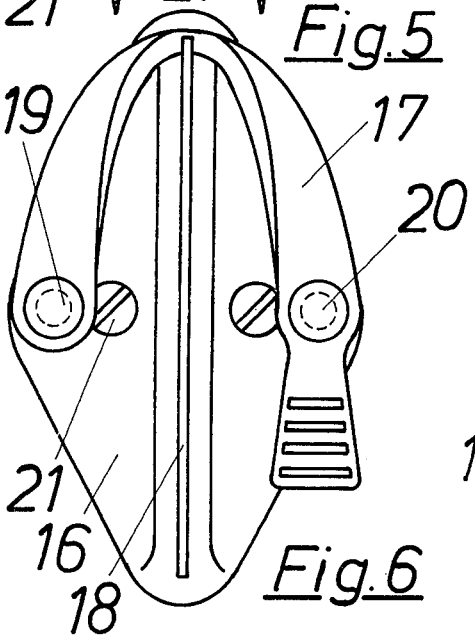
Figure 4:
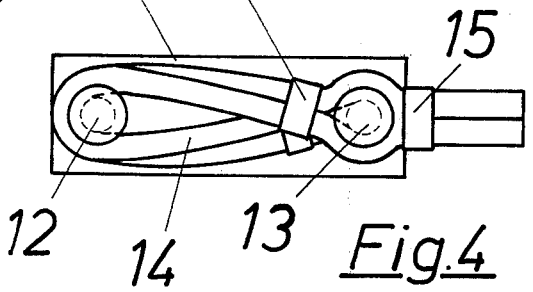

FIGS. 3 and 4 show in side view and in plan, a second embodiment of the holder, unattached to skis; and, FIGS. 5 and 6 show the representations corresponding to FIGS. 3 and 4 of a third embodiment.

Figure 1:
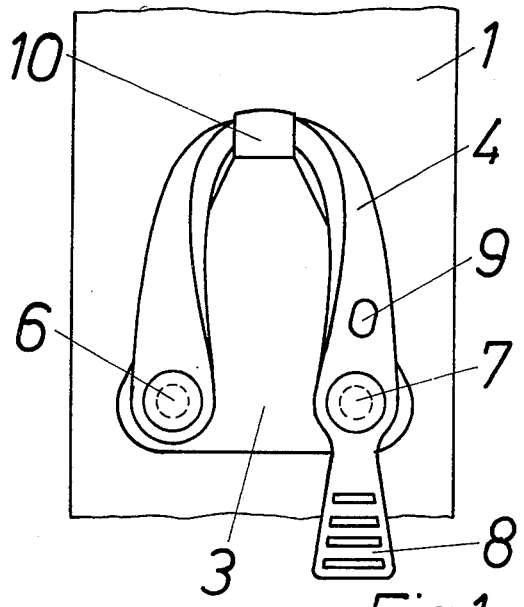
FIG. 1 shows a plan view of a holder according to a first embodiment unattached to skis.
Figure 2:
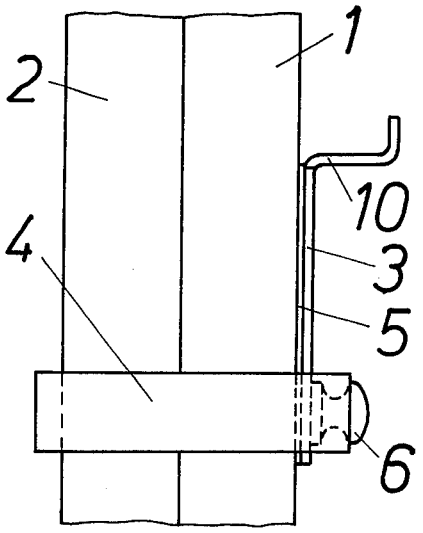
FIG. 2 shows the holder according to FIG. 1 in side view, holding a pair of skis.

The holder represented in FIGS. 1 and 2 for a pair of skis 1,2 which is indicated only by a short section, comprises, according to the invention, only one connecting plate 3 and a flexible and elastic tensioning element 4, for example, in the form of a rubber shaped-piece. The connecting plate has the form of a triangle with rounded corners at the base and is fastened by means of an adhesive coating 5 provided on its ski supporting surface to the ski 1 (or 2). Expediently the fastening is made in the zone directly in front of the ski binding. At the ends of the base of the connecting plate 3 there is provided in each case holding pins 6, 7 for the tensioning element 4. The tensioning element has at one end—for example in reference to FIG. 1 the left end—a hooking-in opening or eye, with which it is slipped onto the holding pin 6. The other end of the tensioning element 4 is formed as a handle 8, and includes two hook-in openings or eyes 9. The tip of the connecting plate 3 is bent off into a hook 10 about which the tensioning element is laid in the holder is not in use as is shown in FIG. 1.

For the clamping of the pair of skis 1 and 2; first, the tensioning element 4 is removed from the holding pin 7 and the two skis are put together. Then the tensioning element is wrapped around the two skis and again fastened with one of the hook-in openings 9 to the holding pin 7. According to the thickness of the skis, the fastening is carried out in the first or second hook-in opening.

Before putting the skis in use the reverse procedure is followed.

According to a variant, the two ends of the tensioning element can, of course, also be made alike—i.e., each with a handle 8 or the like projection over the openings.

FIGS. 3 and 4 show an extremely simple embodiment of the holder according to the invention. The rectangular connecting plate 11 carries only two holding pines 12, 13 for the tensioning element 14. This consists of a two-layered rubber band, which is clamped together by means of clamps 15 to form hook-in places or eyes.

When not clamping skis, the holding pin 12 serves for the deflection or positioning of the rubber band; while in use it holds the free end which, when not in use, is fastened over the other end to the holding pin 13.

The connecting plate 16 of the third embodiment of the holder according to the invention as represented in FIGS. 5 and 6 is rhomboidally shaped. The tensioning element 17 corresponds, however, in the example represented, to that of the first embodiment according to FIGS. 1 and 2, but can be constructed like the embodiment shown in FIGS. 3 and 4. The connecting plate has a rib 18 extending upward and over the long diagonal, while two holding pins 19,20 for the tensioning element lie in the obtuse angles to the connecting plate. The rib forms a scraping strip for cleaning the soles of the ski boots of snow and ice before stepping into the ski binding, so that the binding may function properly, which is not always possible with cakes of snow present under the soles.

For holding the tensioning element 17 when not attached to skis, the face surfaces of the rib 18 are kept concave. Because of the possibly increased strain in the scraping of the ski boot on the rib 18, in this case the connecting plate can be adapted to screw onto the ski.

Screws 21 are provided for this purpose.

I claim:

1. Holder for a pair of skis arranged to grip said skis in a stacked configuration, including a rhomboidally-shaped connecting plate for mounting upon the flat surface of the longitudinal axis of one of said stacked skis, said plate including a scraping strip in the form of an upwardly extending rib disposed over the long diagonal axis of said plate; a single elastic and flexible tensioning element having at least one opening; and a holding pin mounted at an obtuse angle on said plate, said tensioning element engaging said holding pin by means of said opening, said tensioning element secured to said plate opposite said holding pin.

2. The holder of claim 1 in which the face surfaces of the rib are concave for positioning the tensioning element when not engaged in holding said skis.

* * * * *